US008794618B2

(12) United States Patent
Kondo

(10) Patent No.: US 8,794,618 B2
(45) Date of Patent: Aug. 5, 2014

(54) SHEET FEEDING DEVICE, AND DOCUMENT FEEDING APPARATUS AND IMAGE FORMING APPARATUS EQUIPPED THEREWITH

(75) Inventor: Kazuhisa Kondo, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 0 days.

(21) Appl. No.: 12/471,741

(22) Filed: May 26, 2009

(65) Prior Publication Data

US 2009/0295065 A1 Dec. 3, 2009

(30) Foreign Application Priority Data

May 27, 2008 (JP) ..... 2008-137765

(51) Int. Cl.
*B65H 1/18* (2006.01)

(52) U.S. Cl.
USPC ..... 271/152; 271/160; 271/157; 271/154

(58) Field of Classification Search
USPC ..... 271/160, 157, 147, 152, 153, 154, 155
See application file for complete search history.

(56) References Cited

U.S. PATENT DOCUMENTS

| | | | | |
|---|---|---|---|---|
| 4,198,146 | A | 4/1980 | Taguchi et al. | |
| 4,319,740 | A * | 3/1982 | Ulseth | 271/22 |
| 4,763,891 | A * | 8/1988 | Kodama | 271/157 |
| 5,219,155 | A * | 6/1993 | Kanome | 271/114 |
| 5,423,529 | A * | 6/1995 | Saito et al. | 271/127 |
| 5,909,872 | A * | 6/1999 | Takahashi | 271/116 |
| 6,089,562 | A * | 7/2000 | Jang et al. | 271/10.11 |
| 6,337,751 | B1 * | 1/2002 | Kimizuka | 358/498 |
| 6,792,728 | B2 * | 9/2004 | Toulemonde et al. | 52/251 |
| 6,880,822 | B2 * | 4/2005 | Fukushima et al. | 271/157 |
| 6,953,190 | B2 * | 10/2005 | Shin | 271/170 |
| 7,270,323 | B2 * | 9/2007 | Somemiya | 271/127 |
| 7,523,930 | B2 * | 4/2009 | Kang | 271/152 |
| 7,712,736 | B2 * | 5/2010 | Chinzei | 271/157 |
| 7,753,364 | B2 * | 7/2010 | Lyga et al. | 271/127 |
| 8,215,635 | B2 * | 7/2012 | Wada et al. | 271/160 |

(Continued)

FOREIGN PATENT DOCUMENTS

| | | |
|---|---|---|
| JP | A-S54-14731 | 2/1979 |
| JP | 3-216227 A | 9/1991 |

(Continued)

*Primary Examiner* — Ernesto Suarez
(74) *Attorney, Agent, or Firm* — Smith, Gambrell & Russell, LLP

(57) ABSTRACT

A sheet feeding device for a document feeding apparatus includes: a sheet containing section; a lift plate for lifting sheets stacked in the sheet containing section between a sheet feeding position and a sheet loading position; a sheet feeding section for separating and feeding the sheets in the sheet feeding position one after another; and a lifting mechanism for lifting up and down the lift plate, the lifting mechanism including: a biasing member for biasing the lift plate toward the sheet feeding section; a cam, having an outer peripheral surface with a cam curve, coupled with a driving force source and being rotated thereby; and an operating lever so provided independently of and between the lift plate and the cam as to abut the outer peripheral surface of the cam and to simultaneously press the lift plate against a biasing force of the biasing member, thereby to change a posture of the lift plate between the sheet feeding position and the sheet loading position.

8 Claims, 10 Drawing Sheets

(56) References Cited

U.S. PATENT DOCUMENTS

| | | | | |
|---|---|---|---|---|
| 2006/0180994 | A1* | 8/2006 | Jang et al. | 271/126 |
| 2007/0007713 | A1 | 1/2007 | Kurokawa et al. | |
| 2012/0235347 | A1* | 9/2012 | Takiguchi | 271/109 |
| 2013/0168920 | A1* | 7/2013 | Shin et al. | 271/117 |

FOREIGN PATENT DOCUMENTS

| | | | |
|---|---|---|---|
| JP | 04-333466 | | 11/1992 |
| JP | 5-262435 | A | 10/1993 |
| JP | 6-144642 | A | 5/1994 |
| JP | 6-255806 | | 9/1994 |
| JP | 8-73074 | A | 3/1996 |
| JP | 8-268571 | | 10/1996 |
| JP | 10-329959 | A | 12/1998 |
| JP | 2862395 | B2 | 12/1998 |
| JP | 2002-274696 | A | 9/2002 |
| JP | 2007-001762 | | 1/2007 |
| JP | 2008-105790 | | 5/2008 |

* cited by examiner

SHEET FEEDING DEVICE, AND DOCUMENT FEEDING APPARATUS AND IMAGE FORMING APPARATUS EQUIPPED THEREWITH

This application is based on Japanese Patent Application No. 2008-137765 filed on May 27, 2008, the contents of which are hereby incorporated by reference.

BACKGROUND OF THE INVENTION

1. Field of the Invention

The present invention relates to a sheet feeding device feeding sheets of paper such as cut sheets of paper that is applicable to image forming apparatuses represented by copiers and printers. Moreover, the present invention relates to a document feeding apparatus and an image forming apparatus equipped with such a paper feeding apparatus. Hereinafter, a document that contains image data to be printed and sheets of paper to which that image data is to be printed will be collectively referred to as "sheets".

2. Description of Related Art

In image forming apparatuses represented by copiers and printers, a paper feeding apparatus is indispensable for feeding cut sheets of paper and the like. In many paper feeding apparatuses used in image forming apparatuses, a plenty of sheets of a document or paper are stacked in advance inside containers thereof such as a document loading tray or a paper feeding cassette, and then the uppermost one of the stacked sheets inside the containers is separated and fed, one after another, therefrom. Such a paper feeding apparatus is employed in a document feeding apparatus, cassette-type feeding section, manual paper feed section, and the like incorporated in an image forming apparatus.

For paper feeding apparatuses feeding sheets of a document or paper out of the containers, there are two types of mechanisms adoptable, namely a roller feeding type and a sheet suction feeding type, and generally the former is widely used. According to the roller feeding type mechanism, a pickup roller comes into contact with the uppermost one of stacked sheets of a document or paper, and hands it onto paper feeding rollers on the downstream side in a paper feeding direction, so that the paper feeding rollers convey the stacked sheets, one after another, out of the containers.

During the paper feeding, a pickup roller of the paper feeding apparatus and the uppermost of a bundle of documents or paper need to make contact with each other; on the other hand, when the paper feeding is not performed, since the containers may often be loaded or supplied with sheets of a document or paper, at least either the pickup roller or the stacked sheets needs to be moved back so that they do not make contact with each other. To this end, some of the paper feeding apparatuses are provided with a mechanism that is movable between a paper feeding position at which the pickup roller and the uppermost one of the stacked sheets of a document or paper are in contact with each other and a moved-back position at which one of them is away from the other.

Among such paper feeding apparatuses as described above, one example of a paper feeding apparatus pressing a downstream-side portion, in a conveyance direction, of document sheets stacked inside the document loading tray, toward a pickup roller can be seen in JP-H6-255806. The automatic document feeding apparatus (paper feeding apparatus) disclosed in this patent publication is provided with a movable guide plate (lift plate) permitting the downstream-side portions, in the conveyance direction, of stacked sheets of a document to move up and down.

In the automatic document feeding apparatus disclosed in the aforementioned patent publication, an eccentric cam plate provided for movable plate operating means is so rotated by use of a motor as to lift up and down the movable guide plate with the result that the downstream-side portion, in the conveyance direction, of the uppermost one of the stacked sheets can be moved to a paper feeding position. In this apparatus, the cam is brought into contact with a movable plate lever fixed to a supporting shaft of the movable guide plate so as to thereby transmit movement of the cam along the shape thereof directly to the movable guide plate; thus, repeated up- and down-movement of the cam imposes a load on the supporting shaft and hence may lead to the problem of deforming the axial line between the movable guide plate and the movable plate lever, and the like. This creates a concern that the relative position between the movable guide plate and the movable plate lever may be changed from the initial state when they were assembled together, and that the height of the movable guide plate may thus be variable. This may adversely affect the paper feeding operation accordingly.

Moreover, since the movable plate lever is fixed to the rotation shaft of the movable guide plate, these members are in a close positional relationship. Thus, it is necessary to arrange driving force sources including the cam and a motor rotating that cam in the vicinity of the movable guide plate. This inconveniently constitutes a restriction on the construction of the driving force sources. Specifically, in a case where the driving force sources are apart from the movable guide plate, additional mechanism components such as a belt and a plurality of gears are required. This creates another concern that the greatly increased number of materials and components used leads to an increase in costs. In addition, given that a space for arranging those belt and gears should be ensured, there is a possibility to increase the size of the apparatus.

SUMMARY OF THE INVENTION

In view of the foregoing, an object of the present invention is to provide a sheet feeding device in which the uppermost one of stacked sheets of a document or paper is placed in a sheet feeding position by lifting up and down a lift plate, the paper feeding apparatus being capable, of performing a sheet paper feeding operation in a stable manner, with no restriction on a construction of a driving mechanism for the lift plate. Moreover, another object of the present invention is to provide a highly reliable document feeding apparatus and image forming apparatus equipped with such a sheet feeding device.

To solve the above-identified problems, a sheet feeding device of the present invention includes: a sheet containing section; a lift plate for lifting up and down sheets stacked in the sheet containing section between a sheet feeding position and a sheet loading position; a sheet feeding section for separating and feeding the sheets in the sheet feeding position one after another; and a lifting mechanism for lifting up and down the lift plate, the lifting mechanism including: a biasing member for biasing the lift plate toward the sheet feeding section; a cam, having an outer peripheral surface with a cam curve, coupled with a driving force source and rotated thereby; and an operating lever provided independently of and between the cam and the lift plate so as to abut on the outer peripheral surface of the cam and to simultaneously press the lift plate against a biasing force of the biasing member, thereby to change a posture of the lift plate between the sheet feeding position and the sheet loading position.

With this construction, it is possible to transmit movement of the cam indirectly to the lift plate. Owing to this, the occurrence of a problem of deforming the axial line of the supporting shaft can be prevented, and the lift plate can thus be held stably in position. Moreover, it is possible to freely change the location of the operating lever, and hence, it is possible to arrange the cam and the lift plate separately from each other. Accordingly, with a simple construction, it is possible to realize preferable lifting-up and -down operation of the lift plate, with no increase in the size and costs of the sheet feeding device. Thus, it is possible to provide a sheet feeding device being capable of performing a sheet feeding operation in a stable manner, with no restriction on a construction of the driving mechanism for the lift plate.

In the sheet feeding device constructed as described above, the operating lever is, at one side thereof, supported on a body of the apparatus by a supporting shaft provided on that side and is, at another side thereof serving as a free end, swingable around an axial line of the supporting shaft, and the cam and the lift plate are arranged opposite each other with the operating lever in between, so that the lift plate abuts on the vicinity of the free end of the operating lever and that the cam abuts on a middle portion, between the supporting shaft and the free end, of the operating lever.

With this construction, it is possible to form, using the operating lever, a simple mechanism that permits the movement of the cam to be efficiently transmitted to the lift plate. As a result, much freedom is allowed in the design and location of the driving mechanism of the lift plate, leading to increased stability of the sheet feeding operation. In addition, owing to this, as compared with a case where the movement of the cam is directly transmitted to the lift plate via the operating lever, there is little increase in the size and costs of the apparatus.

In the sheet feeding device constructed as described above, the lift plate is, at one side thereof, so supported on the body of the apparatus as to be, at another side thereof serving as a free end, swingable around an axial line of a supporting shaft provided on the other side thereof, and the lift plate further includes, at a side of the free end thereof, an operating pin for abutting on the free end of the operating lever.

With this construction, movement of the operating lever is transmitted to the lift plate through the operating pin. Thus, for example with the operating pin located outside a sheet loading surface of the lift plate, it is possible to prevent the operating lever from interrupting a sheet loading and/or sheet feeding operation. This permits the sheet feeding device to perform a sheet feeding operation in a more stable manner.

In the sheet feeding device constructed as described above, when the lift plate is in the sheet loading position, the operating lever takes a substantially horizontal position.

With this construction, the operating lever can press the lift plate, maintaining its high stability. This leads to the lift plate being held stably in position, permitting the sheet feeding device to continue to perform the sheet feeding operation satisfactorily.

In the sheet feeding device constructed as described above, the operating lever is so formed as to have an I-shape in a cross section perpendicular to a longitudinal direction, and from above and below the I-shape, the cam and the lift plate abut on the operating lever, respectively.

With this construction, a section modulus being high helps increase the strength of the operating lever. Thus, even in a case where there is a load imposed between the cam and the lift plate, it is possible to prevent the operating lever from being deformed. Owing to this, the lift plate can be held even more stably in position, permitting the sheet feeding operation to be repeatedly performed satisfactorily.

In the sheet feeding device constructed as described above, in the lifting mechanism, the cam and the operating lever are arranged, with respect to the lift plate, on a side opposite to a direction in which the biasing member biases the lift plate.

With this construction, with a force of the biasing member, the uppermost one of the stacked sheets is made to come into contact with and to depart from the pickup roller; this operation is controlled by the cam and the operating lever. The force of the biasing member thus regulated makes it possible to set the contact between a sheet and the pickup roller in a preferable condition, and moreover, combination of the force of the biasing member with the control performed by the cam and the operating lever makes it possible to accomplish a smooth sheet feeding operation.

Moreover, according to the present invention, a document feeding apparatus is equipped with a sheet feeding device including: a sheet containing section; a lift plate for lifting up and down sheets stacked in the sheet containing section between a sheet feeding position and a sheet loading position; a sheet feeding section for separating and feeding the sheets in the sheet feeding position one after another; and a lifting mechanism for lifting up and down the lift plate, the lifting mechanism including: a biasing member for biasing the lift plate toward the sheet feeding section; a cam, having an outer peripheral surface with a cam curve, coupled with a driving force source and rotated thereby; and an operating lever provided independently of and between the cam and the lift plate so as to abut on the outer peripheral surface of the cam and to simultaneously press the lift plate against a biasing force of the biasing member, thereby to change a posture of the lift plate between the sheet feeding position and the sheet loading position.

With this construction, it is possible to provide a highly reliable document feeding apparatus being capable of performing a sheet feeding operation in a stable manner, with no restriction on a construction of a driving mechanism for the lift plate, which is so swingable as to change the uppermost one of the stacked sheets in a sheet feeding position.

Moreover, according to the present invention, an image forming apparatus is equipped with a sheet feeding device including: a sheet containing section; a lift plate for lifting up and down sheets stacked in the sheet containing section between a sheet feeding position and a sheet loading position; a sheet feeding section for separating and feeding the sheets in the sheet feeding position one after another; and a lifting mechanism for lifting up and down the lift plate, the lifting mechanism including: a biasing member for biasing the lift plate toward the sheet feeding section; a cam, having an outer peripheral surface with a cam curve, coupled with a driving force source and rotated thereby; and an operating lever provided independently of and between the cam and the lift plate so as to abut on the outer peripheral surface of the cam and to simultaneously press the lift plate against a biasing force of the biasing member, thereby to change a posture of the lift plate between the sheet feeding position and the sheet loading position.

With this construction, it is possible to provide a highly reliable image forming apparatus being capable of performing a sheet feeding operation in a stable manner, with no restriction on a construction of a driving mechanism for the lift plate, which is so swingable as to change a document or the uppermost one of stacked sheet in a sheet feeding position.

DETAILED DESCRIPTION OF PREFERRED EMBODIMENTS

Hereinafter, an embodiment of the present invention will be described with reference to FIGS. 1 to 10.

Figure 1:
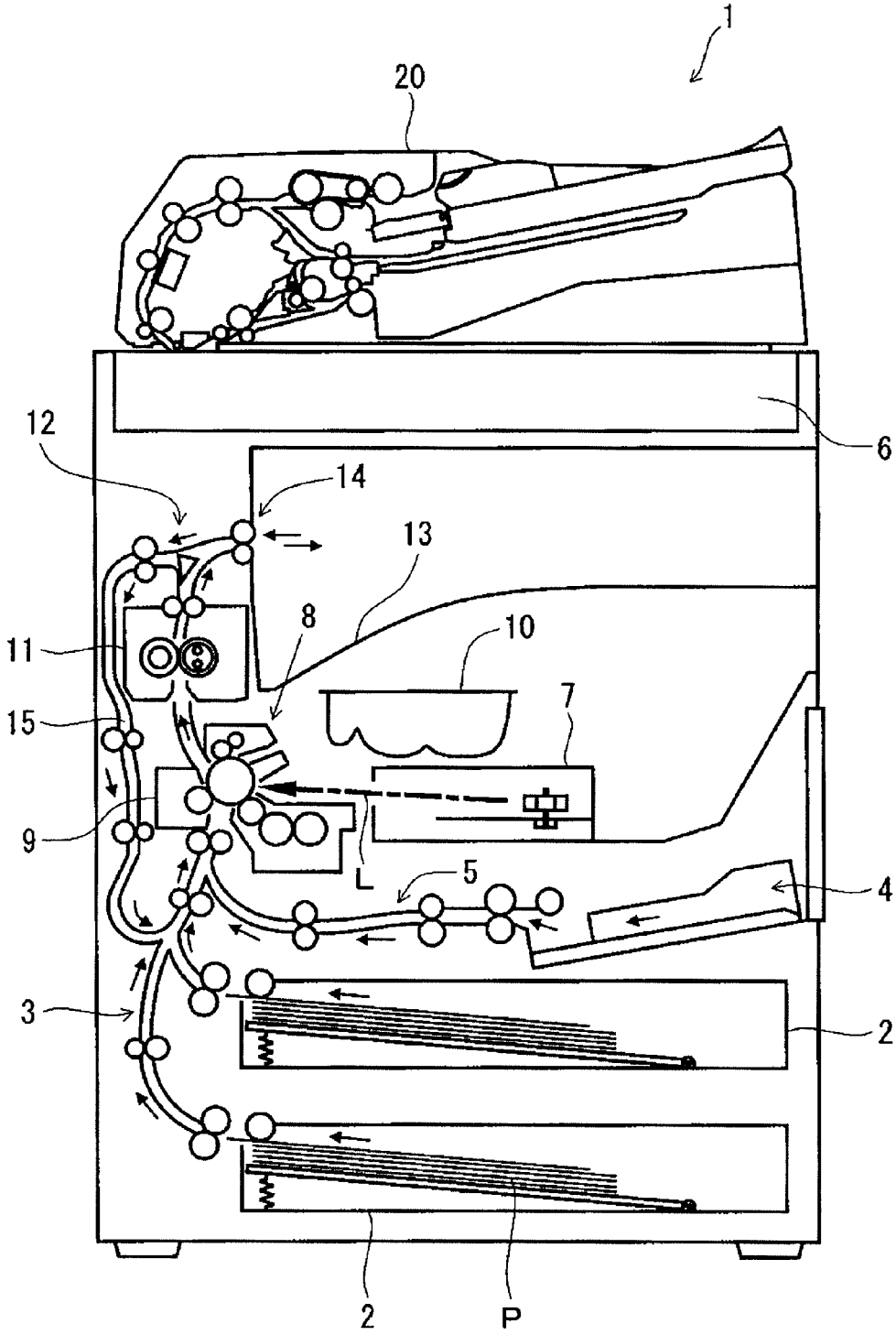
FIG. 1 is a vertical cross-sectional front view of a model of an image forming apparatus equipped with a document feeding apparatus according to an embodiment of the present invention.

In respect of an image forming apparatus equipped with a sheet feeding device according to an embodiment of the present invention, the outline of its construction and an image output operation will be described with reference to FIG. 1. FIG. 1 is a vertical cross-sectional front view of an image forming apparatus shown as a model. In this figure, arrowed solid lines represent sheet conveyance passages and directions, and an arrowed dot-dash line represents a laser beam L.

As shown in FIG. 1, paper cassettes 2 are disposed at the bottom inside the image forming apparatus 1. Inside the paper cassettes 2, unprinted sheets of paper P are contained in a stack. From the paper cassette 2, the sheets of paper P are separated and fed one after another in the upper-left direction in FIG. 1. The paper cassettes 2 can be pulled out horizontally from the front surface side of the image forming apparatus 1.

Inside the image forming apparatus 1, a first sheet conveying section 3 is disposed on the left side of the paper cassettes 2. The first sheet conveying section 3 is so formed as to be substantially vertical along the left side surface of the image forming apparatus 1. The first sheet conveying section 3 receives a sheet of paper P fed from the paper cassette 2, and then conveys it in the vertical upward direction along the left side surface of the image forming apparatus 1 to a transfer section 9.

Above the paper cassettes 2, a multi sheet feeding section 4 is disposed at the right side of the image forming apparatus 1. What is loaded on the multi sheet feeding section 4 includes sheets desirably fed one by one such as sheets of normal paper with a size other than those within the specifications of the sheet feed cassettes 2, thick paper, and OHP sheets.

To the left of the multi sheet feeding section 4, a second sheet conveying section 5 is disposed. The second sheet conveying section 5 is located right above the paper cassettes 2, and extends substantially horizontally from the multi sheet feeding section 4 to the first sheet conveying section 3 so as to join the first sheet conveying section 3. The second sheet conveying section 5 receives a sheet of paper P fed from the multi sheet feeding section 4, and then conveys it substantially horizontally to the first sheet conveying section 3.

On the other hand, at the top of the image forming apparatus 1, a document feeding apparatus 20 is disposed, and below it, an image reading apparatus 6 is disposed. To copy a document, a user places, on the document feeding apparatus 20, a stack of sheets of a document having images such as letters, figures, patterns or the like written thereon. The document feeding apparatus 20 separates and conveys one sheet after another from the stack, and then the image reading section 6 reads image data thereof.

Starting of reading of a document, namely printing is performed by using an operation panel (not shown) disposed at the top of the image forming apparatus 1, at the front surface side of the image reading section 6. Through this panel, a user can enter and set printing conditions etc. such as the size of a sheet used, selection of enlargement or reduction, and selection of double-side printing.

Information of the image data of the document is sent to an exposure apparatus 7 disposed above the second sheet conveying section 5 in the middle portion of the image forming apparatus 1. The exposure apparatus 7 shines the laser beam L that is controlled based on the image data toward an image forming section 8.

Above the first sheet conveying section 3 and to the left of the exposure apparatus 7, an image forming section 8 and a transfer section 9 are disposed. In the image forming section 8, an electrostatic latent image of the document is formed with the laser beam L shone by the exposure apparatus 7, and then from this electrostatic latent image, a toner image is developed. A toner is supplied from a toner container 10 disposed above the exposure apparatus 7 to the image forming section 8. The transfer section 9 transfers a toner image formed by the image forming section 8 to an unprinted sheet of paper P that has been synchronously conveyed there by the first sheet conveying section 3.

Above the transfer section 9, a fixing section 11 is disposed. The sheet of paper P that is made to carry an unfixed toner image by the transfer section 9 is conveyed onto the fixing section 11, and there the toner image is heated and pressed on the sheet by heating and pressing rollers, so that the image is fixed thereon.

A sheet guide apparatus 12 is disposed above the fixing apparatus 11. When the double-side printing is not performed, the sheet of paper P ejected from the fixing apparatus 11 is then ejected, through the sheet guide apparatus 12, into an internal ejected sheet section 13 disposed inside the body frame of the image forming apparatus 1.

An exit through which the sheet of paper P is ejected from the sheet guide apparatus 12 to the internal ejected sheet section 13 functions as a switchback 14. When double-side printing is performed, the switchback 14 changes the conveyance direction of the sheet of paper P ejected from the fixing apparatus 11. Then, the sheet of paper P, passing through the sheet guide apparatus 12, is conveyed backward through the double-side printing sheet conveyance passage 15 disposed to the left of the fixing and transfer sections 11 and 9, and is conveyed onto the transfer section 9 again through the first sheet conveying section 3.

Figure 2:
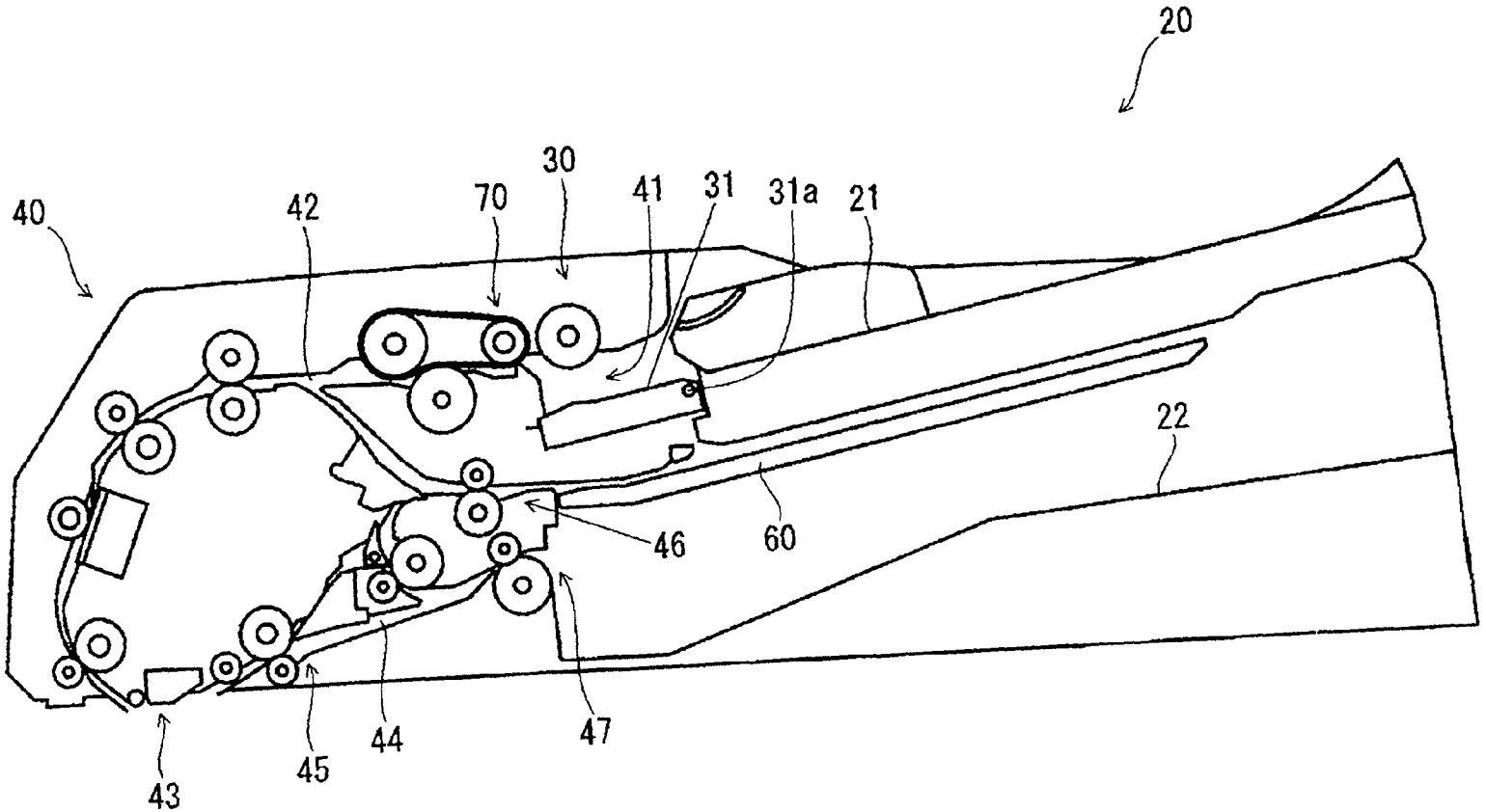
FIG. 2 is a vertical cross-sectional front view of the document feeding apparatus shown as a model in FIG. 1.

Next, in respect of the document feeding apparatus 20 mounted at the top of the image forming apparatus 1, the outline of its construction will be described with reference to FIG. 2. FIG. 2 is a vertical cross-sectional front view of the document feeding apparatus presented as a model.

As shown in FIG. 2, the document feeding apparatus 20 includes: a document loading tray 21 serving as a sheet containing section; a sheet feeding device 30; a document conveying section 40; and an ejected document tray 22.

The document loading tray 21 is disposed at the top of the document feeding apparatus 20. On the document loading tray 21, sheets of a document can be loaded in a stack from the above. The document loading tray 21 is so formed as to be inclined from an upstream to a downstream in a document conveyance direction, namely downward from right to left in FIG. 2.

Figure 4:
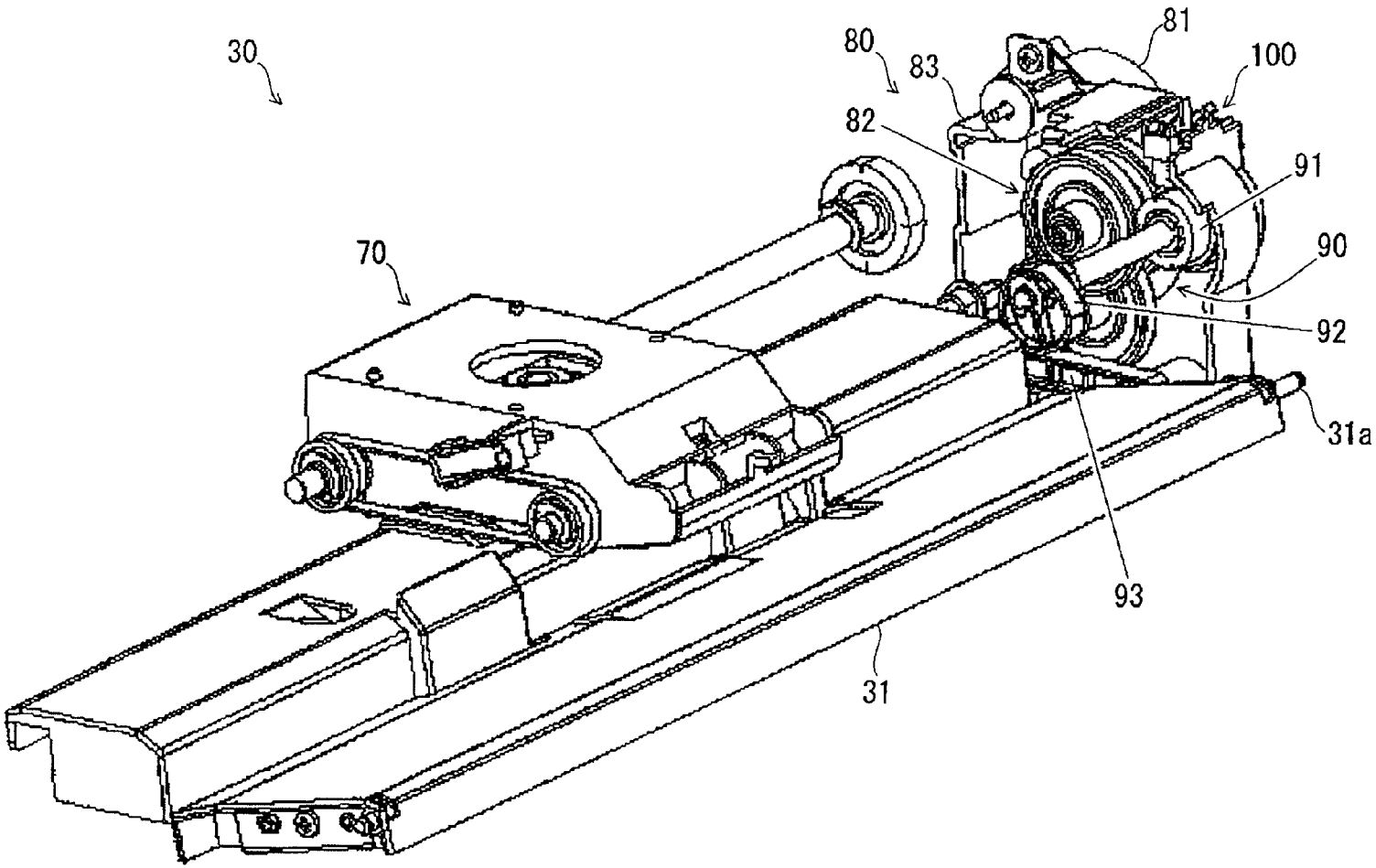
FIG. 4 is a partially enlarged perspective view, as seen from the front, showing a lift plate and a sheet feeding section, and a vicinity thereof shown in FIG. 2.

The sheet feeding device 30 is disposed in a downstream-side portion, in the document conveyance direction, of the document loading tray 21 and includes: a lift plate 31; a sheet feeding section 70; and a driving mechanism 80 for the lift plate 31 (see FIG. 4).

The lift plate 31 is formed with a plate-like member having a shape extending along a loading surface of the document loading tray 21. The lift plate 31 is supported by the apparatus body such that a downstream side of the plate serving as a free end is made freely swingable within a vertical plane with respect to the document conveyance direction around an axial line of a supporting shaft 31*a* disposed in an upstream-side portion of the plate. The lift plate 31 is allowed by the driving mechanism 80 therefor to lift up and down a downstream-side portion, in the conveyance direction, of a sheet of a document loaded on the document loading tray 21, between a sheet feeding position and a loading position.

The sheet feeding section 70 separates the uppermost sheet from the other sheets of a document stacked in the document loading tray 21, one after another, and then feeds it to an interior portion of the document conveying section 40, namely to the left in FIG. 2. The construction of the sheet feeding device 30 will be described in detail later.

The document conveying section 40 includes a document feeding opening 41 at the downstream end, in the document conveyance direction, of the document loading tray 21. On the downstream side of the document feeding opening 41, a first document conveyance passage 42 extends toward the interior portion of the document conveying section 40.

The end of the first document conveyance passage 42 reaches a bottom surface of the document feeding apparatus 20, and at this position, a document reading section 43 is disposed. Continuous with the first document conveyance passage 42, a second document conveyance passage 44 extends starting from the position of the document reading section 43. When a sheet of a document conveyed to the document reading section 43 moves further to the downstream side from the first to the second document conveyance passage 42 to 44, namely from left to right at the position of the document reading section 43 in FIG. 2, the image data on a first side of that sheet, which is a side facing down, is read by the image reading apparatus 6 (see FIG. 1) disposed below the document reading section 43.

On the second document conveyance passage 44, a document switching section 45 is disposed to the downstream side of the document reading section 43. When the image data on both sides of a sheet of a document needs be read, the sheet reaching the document switching section 45 is sorted upward on the second document conveyance passage 44. The conveyance direction of the sheet is switched back by a document reversing section 46 continuing on the downstream side in the document conveyance direction. The sheet of the document whose conveyance direction has been changed is conveyed, through an upper side of the document switching section 45, to the first document conveyance passage 42 on the upstream side of the document reading section 43, and there, the image data on a second side of the sheet is also read by the document reading section 43.

On the downstream side of the document switching section 45 and at the downstream end of the second document conveyance passage 44, a document ejecting port 47 is disposed. Sheets of a document of which the image data has been read are ejected from the document ejecting port 47 to the ejected document tray 22.

The ejected document tray 22 is disposed below the document loading tray 21. These trays are so arranged as to form two stages, namely upper and lower stages sandwiching a switchback tray 60. The sheets of a document ejected onto the ejected document tray 22 can be taken out thereof from the front surface side of the document feeding apparatus 20.

The document loading tray 21 and ejected document tray 22 are so arranged as to deliver sheets in opposite conveyance directions; that is, as seen in FIG. 2, the document loading tray 21 feeds a sheet of a document to the left, whereas the ejected document tray 22 ejects a sheet of a document to the right. With this arrangement, the document feeding opening 41 and ejecting port 47 are disposed at the same side, namely to the left, in FIG. 2, of the respective trays with respect to the direction in which the document reading section 43 is located. The first and second document conveyance passages 42 and 44 extending from the document feeding opening 41 via the position of the original reading section 43 to the ejected document port 47 are so formed as to have a U shape as shown in FIG. 2 in the up/down direction; that is, they are bent in a U shape as seen from the front.

With the above-described construction, the document feeding apparatus 20 separates the sheets of a document stacked in the document loading tray 21, one after another, and feeds it into the document conveying section 40; after the document reading section 43 reads the image data of those sheets, they are ejected to the document tray 22.

Figure 3:
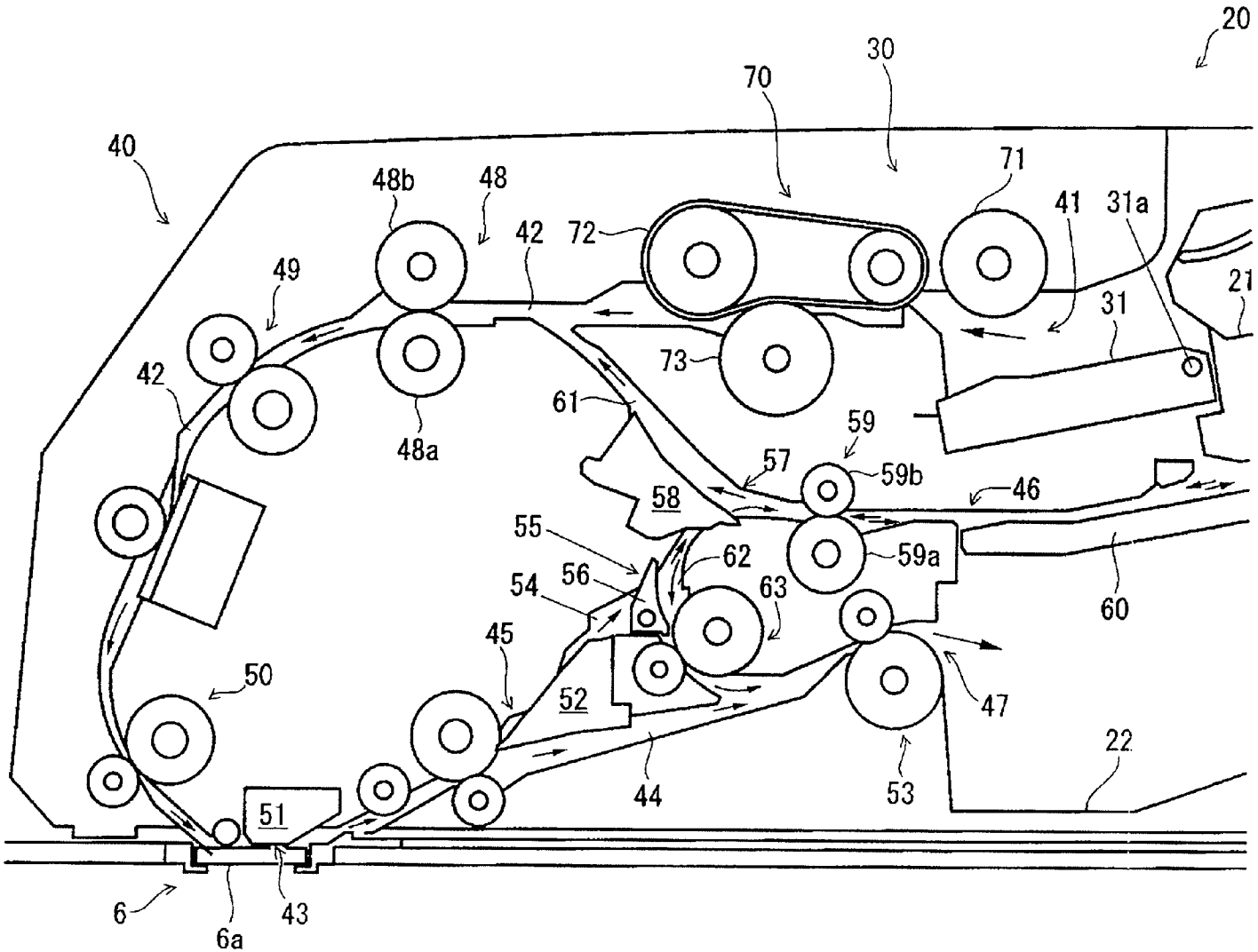
FIG. 3 is a vertical cross-sectional front view of a document conveying section of the document feeding apparatus shown in FIG. 2.

Next, the constructions of the sheet feeding device 30 and document conveying section 40 of the document feeding apparatus 20 will be described in detail with reference to FIG. 3 in addition to FIG. 2. FIG. 3 is a vertical cross-sectional front view of the document conveying section of the document feeding apparatus. In FIG. 3, arrowed solid lines represent conveyance passages and directions of a sheet of a document.

As described earlier, the sheet feeding device 30 includes: the lift plate 31 and the sheet feeding section 70 at the downstream end, in the document conveyance direction, of the document loading tray 21 (see FIG. 3). At the location of the sheet feeding device 30, a document feeding opening 41 of the document feeding section 40 is disposed. As shown in FIG. 3, on the downstream side of the document feeding opening 41, the first document conveyance passage 42 extends downward.

The sheet feeding section 70 of the sheet feeding device 30 is disposed above substantially a middle portion in the width direction of a sheet of a document, the direction being perpendicular to the document conveyance direction, and includes: a pickup roller 71; a sheet feeding belt 72; and a separating roller 73.

The pickup roller 71 is disposed right on the downstream side of the document feeding opening 41. The pickup roller 71 is rotatably supported by a supporting member (not shown) so mounted on the apparatus body as to be swingable around an axial line of a substantially horizontal supporting shaft disposed on the further downstream side, within a vertical plane with respect to the document conveyance direction. Thus, the pickup roller 71 is swingable up and down around the axial line of the supporting shaft of the supporting member, within the vertical plane with respect to the document conveyance direction. When a sheet of a document is fed, downstream-side portions of the sheets of a document stacked in the document loading tray 21 are lifted up by the lift plate 31, so that the downstream-side end of the uppermost sheet makes contact with the pickup roller 71 from below. The uppermost sheet of the document is handed to the sheet feeding belt 72 by the pickup roller 71, and is then conveyed into the interior portion of the document conveying section 40.

The sheet feeding belt 72 is arranged on the downstream side of the pickup roller 71 such that a lower portion of its surface protrudes to the first document conveyance passage 42. The sheet feeding belt 72 is wound around two pulleys and rotates clockwise so that it can convey a sheet of a document from the document feeding opening 41 to the left in FIG. 3. The separating roller 73 is disposed below the sheet feeding belt 72 keeping in contact therewith. A sheet of a document is inserted in a conveyance nip formed by the sheet feeding belt 72 abutting on the separating roller 73.

When more than one sheet of a document at a time advance to the conveyance nip formed by the sheet feeding belt 72 abutting on the separating roller 73, only the upper one of the overlapping sheets is conveyed by the sheet feeding belt 72. Thanks to a working of the separating roller 73, the lower one is not conveyed, thus preventing a problem called double-sheet feeding, in which a plurality of sheets are forced to be conveyed overlapping.

On the first document conveyance passage 42, a pair of resist rollers 48 and pairs of conveying rollers 49 and 50 are disposed on the downstream side of the sheet feeding section 70. The pair of resist rollers 48 is composed of a resist roller 48*a* and a follower roller 48*b* making press-contact with each other, and with respect to a sheet of a document bound for the document reading section 43, corrects skew-feeding and conveys the relevant sheet at preferable timing, so that appropriate reading can be performed there.

On the downstream side of the pair of the conveying rollers 50, the document reading section 43 is disposed. Here, the first document conveyance passage 42 extending from the document feeding opening 41 is so bent as to run counter-clockwise as seen from the front through the sheet feeding section 70, the pair of resist rollers 48, and the pairs of conveying rollers 49 and 50 until it reaches the document reading section 43. Thus, the first document conveyance passage 42 extends leftward and then downward in FIG. 3 on the upstream side of the document reading section 43, and continuous with the first document conveyance passage 42, the second document conveyance passage 44 extends, diagonally to the upper right on the downstream side of the document reading section 43, up to the document ejecting port 47 and ejected document tray 22.

The document reading section 43 includes a reading guide member 51. The reading guide member 51 is so arranged as to face a contact glass 6*a* of the image reading apparatus 6 disposed below the document reading section 43. The reading guide member 51 lies extensively in the width direction of a sheet of a document, namely in the front/rear direction of the document feeding apparatus 20, and has a portion guiding a sheet of a document formed into a protruding shape protruding downward. With the document feeding apparatus 20 in a closed state with respect to the image reading apparatus 6, the reading guide member 51 located therebelow guides a sheet of a document being conveyed between the reading guide member 51 and the contact glass 6*a* so that the sheet makes contact with the contact glass 6*a*.

When a sheet of a document conveyed to the document reading section 43 moves from the first to the second document conveyance passage 42 to 44, from left to right in FIG. 3 below the reading guide member 51, that is, when it is passed above the contact glass 6*a*, the image data thereof is read by a reading unit (not shown) disposed below the contact glass 6*a*.

On the downstream side of the document reading section 43, on the second document conveyance passage 44, a document switching section 45 is disposed. The document switching section 45 includes a switching guide 52 that is swingable, within a vertical plane, around a supporting shaft (not shown) extending substantially horizontally in the front/rear direction. The switching guide 52 lies extensively in the front/rear direction, namely in the width direction of a sheet of a document, and is so formed as to have a wedge-like shape in a vertical section when seen from the front of its end portion on the upstream side in the document conveyance direction, so that sheets of a document are easily sorted. The switching guide 52 is driven by a solenoid (not shown), which is a driving apparatus, disposed at the rear side, and changes its posture so that its end portion on the upstream side in the document conveyance direction sways up and down.

On the downstream side of the document switching section 45 and at the downstream side end of the second document conveyance passage 44, the document ejecting port 47 and a pair of document ejecting rollers 53 are disposed. A sheet of a document, after the image data is read thereof, is ejected by the pair of document ejecting rollers 53 from the document ejecting port 47 to the ejected document tray 22 (see FIG. 2).

On the other hand, on the downstream side of the document switching section 45, a third document conveyance passage 54 extends diagonally to the upper right with respect to the second document conveyance passage 44 extending substantially rightward in FIG. 3. When reading of the image data needs be performed on both sides of a sheet of a document, the switching guide 52 of the document switching section 45 changes its posture to face downward, and conveys the sheet of which the image data on the first side has been read by the document reading section 43 from the middle of the second document conveyance passage 44 via the third document conveyance passage 54 into the document reversing section 46.

A first document branch section 55 is disposed on the downstream side of the document switching section 45 on the third document conveyance passage 54. The first document branch section 55 is a branch point branching into a fifth document passage 62, which will be described later, disposed closer to the ejected document tray 22 than the third document conveyance passage 54 is, and includes a first branch guide 56 between the third and fifth document conveyance passages 54 and 62.

The first branch guide 56 lies extensively in the front/rear direction of the document feeding apparatus 20 (document width direction), and is so formed as to have a wedge-like shape in a vertical section when seen from the front of a downstream-side end portion, namely an upper end portion of the third document conveyance passage 54. The first branch guide 56 is supported with its lower portion connected to a spring member (not shown) on a frame of the document feeding apparatus 20, so that an upper end portion of the first branch guide 56 is swingable around this supporting portion within a vertical plane with respect to the document conveyance direction.

The first branch guide 56 is arranged such that its upper end portion blocks the third document conveyance passage 54. The spring member supporting the first branch guide 56 has such a degree of force of repulsion as to allow itself to bend with a sheet of a document abutting on the first branch guide 56. Thus, when a sheet of a document passes through the third document conveyance passage 54, the first branch guide 56 changes its posture so that its downstream-side end portion, namely its upper end portion sways rightward in FIG. 3. Then, when that sheet has completely passed through the first branch guide 56, or when no sheet of a document is in contact therewith, the first branch guide 56 sways its upper end portion leftward so as to maintain a posture shown in FIG. 3, namely such a posture as to block the third document conveyance passage 54.

At the downstream-side end of the third document conveyance passage 54 and between that end and the document reversing section 46, a second document branch section 57 is disposed. The second document branch section 57 includes a second branch guide 58. The second branch guide 58 lies extensively in the front/rear direction of the document feeding apparatus 20 (document width direction), and is so formed as to have a wedge-like shape in a vertical section when seen from the front of a downstream-side end portion, namely a right end portion, in FIG. 3, of the third document conveyance passage 54. The second branch guide 58 has, at the left side thereof, a supporting shaft (not shown) extending substantially horizontally in the front/rear direction, and is swingable around this supporting shaft within a vertical plane with respect to the document conveyance direction.

The second branch guide 58 is arranged such that its right end portion blocks the third document conveyance passage 54. The second branch guide 58 is so formed as to have such a degree of weight as to allow itself to be swingable around the supporting shaft with a sheet of a document abutting on the right end portion of the second branch guide 58. Thus, when a sheet of a document passes through the third document conveyance passage 54, the second branch guide 58 changes its posture so as to sway a downstream-side end portion thereof, namely the right end portion thereof upward in FIG. 3. Then, when that sheet has completely passed through the second branch guide 58, or when no sheet of a document is in contact therewith, the second branch guide 58 sways its right end portion downward under the action of gravity and an unillustrated stopper so as to maintain a posture shown in FIG. 3, namely such a posture as to block the third document conveyance passage 54.

The document reversing section 46 is disposed on the downstream side of the third document conveyance passage 54 and above the upstream side of the second document conveyance passage 44, and includes a pair of reversing rollers 59 and a switchback tray 60.

The pair of reversing rollers 59 are disposed at the uppermost stream end of the document reversing section 46 with respect to the third document conveyance passage 54, and are composed of a reversing roller 59*a* and a follower roller 59*b* making contact with each other and thereby forming a conveyance nip for conveying a sheet of a document. The reversing roller 59*a* is rotated clockwise and counterclockwise in FIG. 3 by an unillustrated motor. The follower roller 59*b* makes press-contact with the reversing roller 59*a* from above. The switchback tray 60 is disposed right below the document loading tray 21 with a comparatively narrow gap in between and, like the document loading tray 21, extends obliquely upward (see FIG. 2).

In the document reversing section 46, in respect of a sheet of a document having been conveyed through the third document conveyance passage 54 from left to right in FIG. 3, a downstream-side portion thereof is once conveyed into the switchback tray 60, and then when an upstream-side portion thereof is about to pass through the pair of reversing rollers 59, the reversing roller 59*a* is reversely rotated with the sheet retained in the conveyance nip between the reversing and follower rollers 59*a* and 59*b*, thereby to change the document conveyance direction to be from right to left.

In FIG. 3, a fourth document conveyance passage 61 is disposed to the left side of the document reversing section 46 and second branch section 57, and above the third document conveyance passage 54 and document reading section 43. The fourth document conveyance passage 61 extends from where the document reversing section 46 and second document branch section 57 are located to the left in FIG. 3, and then joins, further ahead, to the upstream side of the resist rollers 48 on the first document conveyance passage 42. Thus, the sheet of a document that has completely passed through the second document branch section 57 and whose conveyance direction has been changed by the document reversing section 46, passes through the fourth document conveyance passage 61, is again conveyed into the first document conveyance passage 42 on the upstream side of the document reading section 43, and then reaches the document reading section 43, where the image data on the second side facing down is read.

A fifth document conveyance passage 62 is disposed in such a way as to branch off from the third document conveyance passage 54 at the first document branch section 55 on the upstream side of the second document branch section 57, which is located halfway through the third document conveyance passage 54 and serves as a branch point between the third and fourth document conveyance passages 54 and 61. The fifth document conveyance passage 62 branches off from the third document conveyance passage 54 at the first document branch section 55, extends downward, and then joins to the second document conveyance passage 44 on the downstream side of the document switching section 45 having the switching guide 52. Midway through the fifth document conveyance passage 62, a pair of conveying rollers 63 are disposed. The fifth document conveyance passage 62 conveys the sheets of a document along the conveyance direction of the second document conveyance passage 44 toward the ejected document tray 22, so that those sheets of which reading of the image data has been finished for both sides are conveyed into the document reversing section 46 again and are switched back thereby to be ejected into the ejected document tray 22 with a front/back orientation coinciding with that when they are stacked in the document loading tray 21 in the first place.

Figure 6:
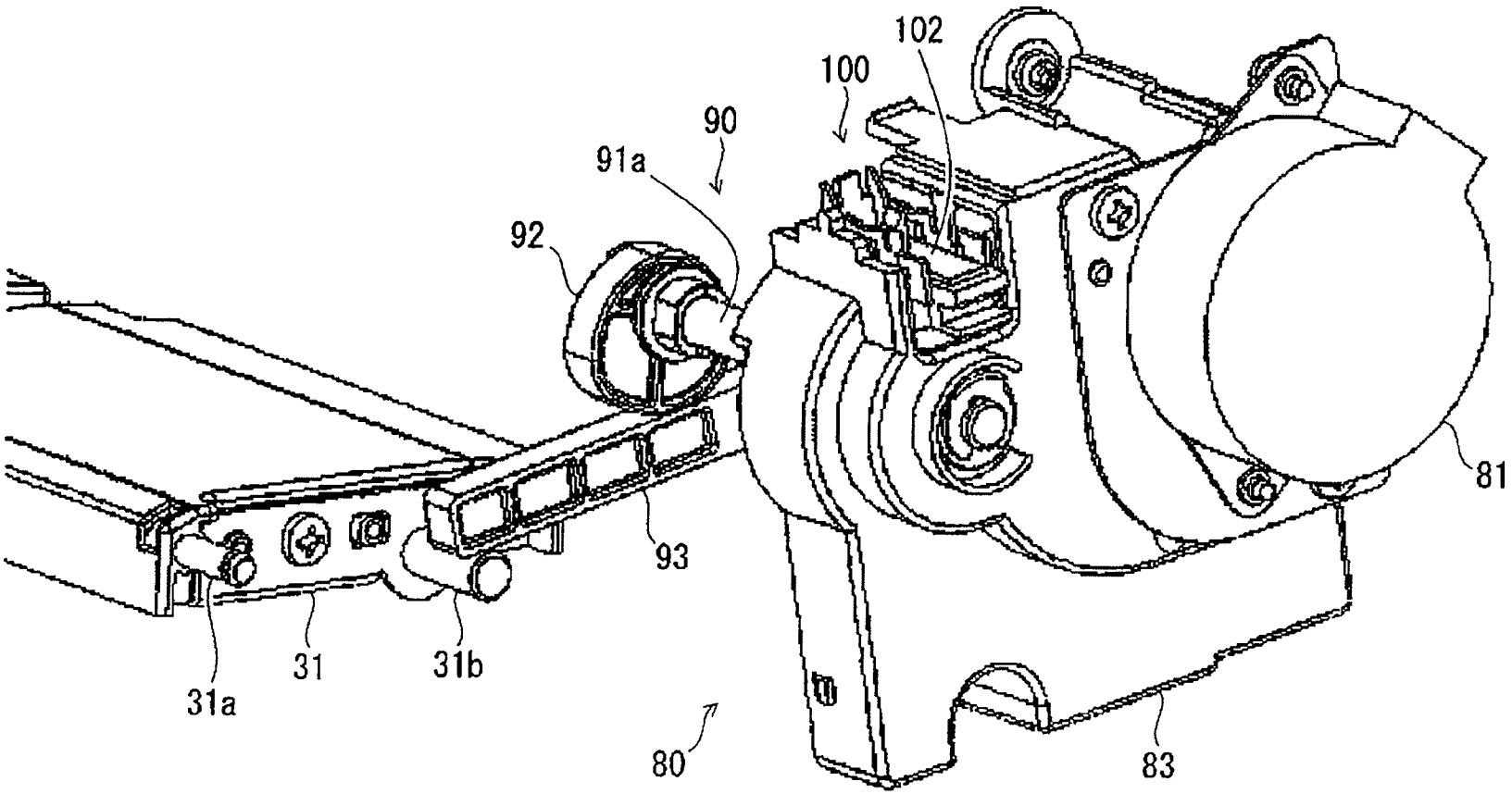
FIG. 6 is a partially enlarged perspective view of the lift plate FIG. 2 and the driving mechanism, and a vicinity thereof as seen from the rear.
Figure 7:
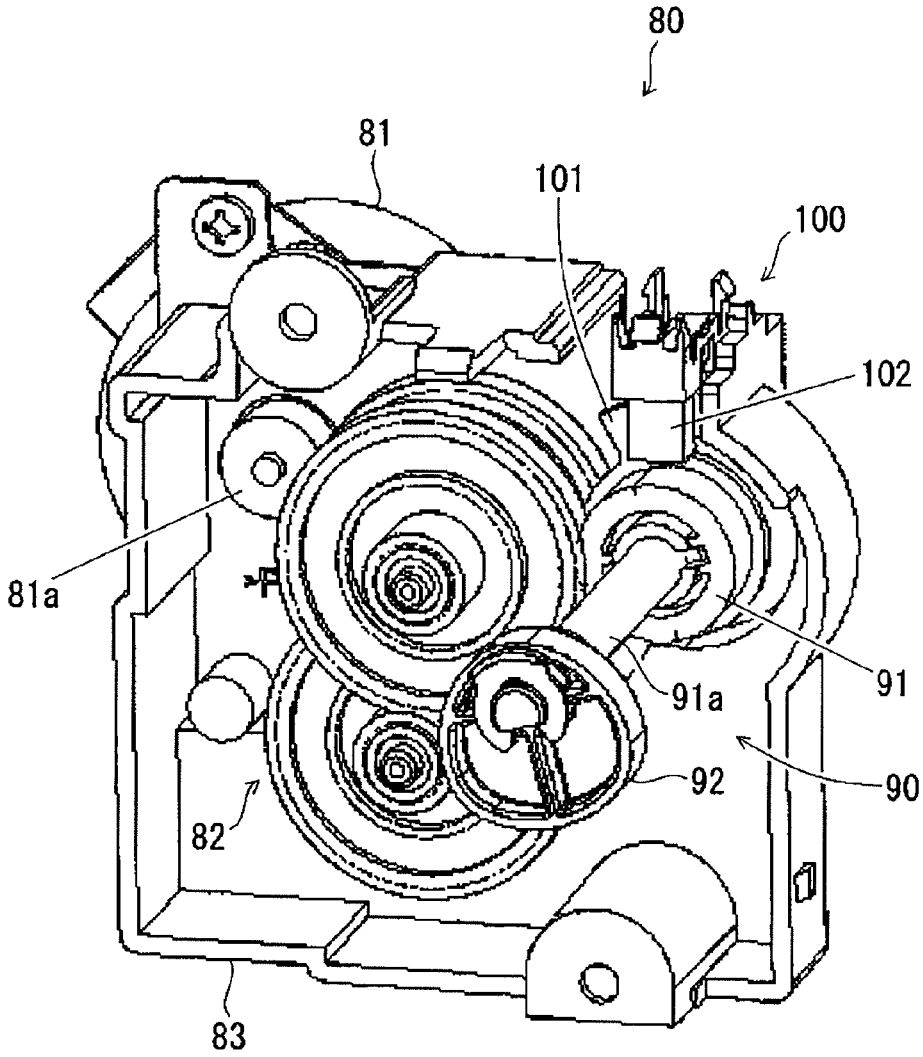
FIG. 7 is a perspective view of part of a driving mechanism for the lift plate shown in FIG. 4.
Figure 8:
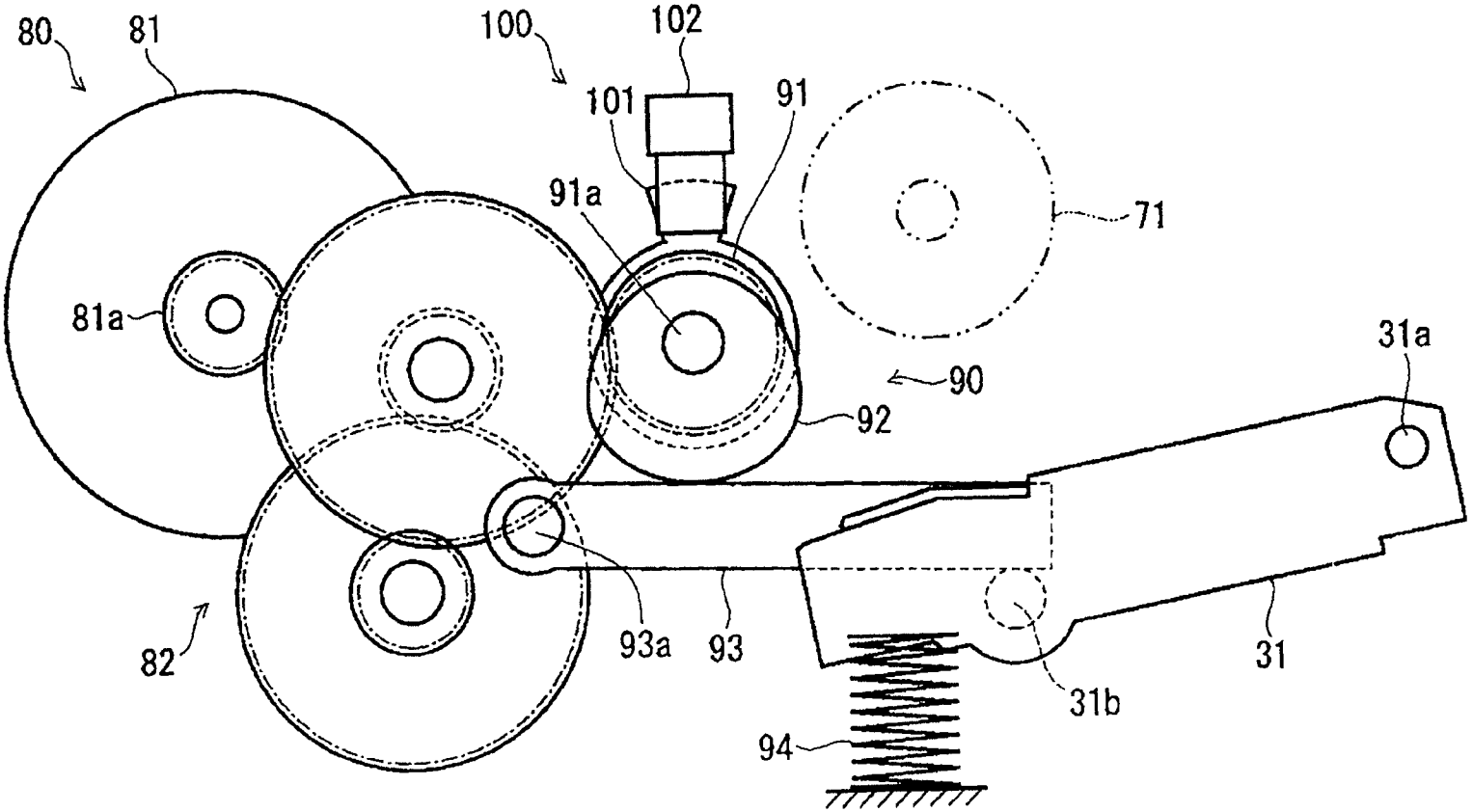
FIG. 8 is a partially enlarged front view showing how the lift plate in FIG. 4 and the driving mechanism therefor are arranged.
Figure 9:
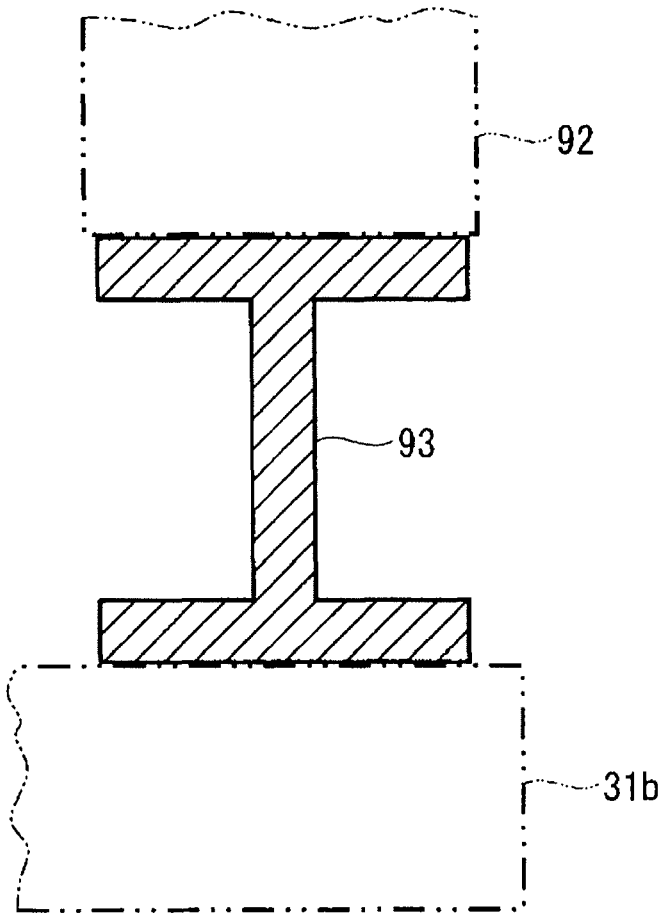
FIG. 9 is a vertical cross-sectional view of an operating lever of a lifting mechanism shown in FIG. 5.

Next, in connection with an operation of the lift plate 31 of the sheet feeding device 30, its mechanism will be described with reference to FIGS. 4 to 9 in addition to FIG. 3. FIG. 4 is a partially enlarged perspective view showing the lift plate and the sheet feeding device, and the vicinity thereof as seen from the front, FIG. 5 is a partially enlarged perspective view of the lift plate and a driving mechanism therefor as seen from the front, FIG. 6 is a partially enlarged perspective view of the driving mechanism for the lift plate and the vicinity thereof as seen from the rear, FIG. 7 is a perspective view of part of the driving mechanism for the lift plate, FIG. 8 is a partially enlarged front view showing how the lift plate and driving mechanism therefor are arranged, and FIG. 9 is a vertical cross-sectional view of an operating lever of a lifting mechanism.

Figure 5:
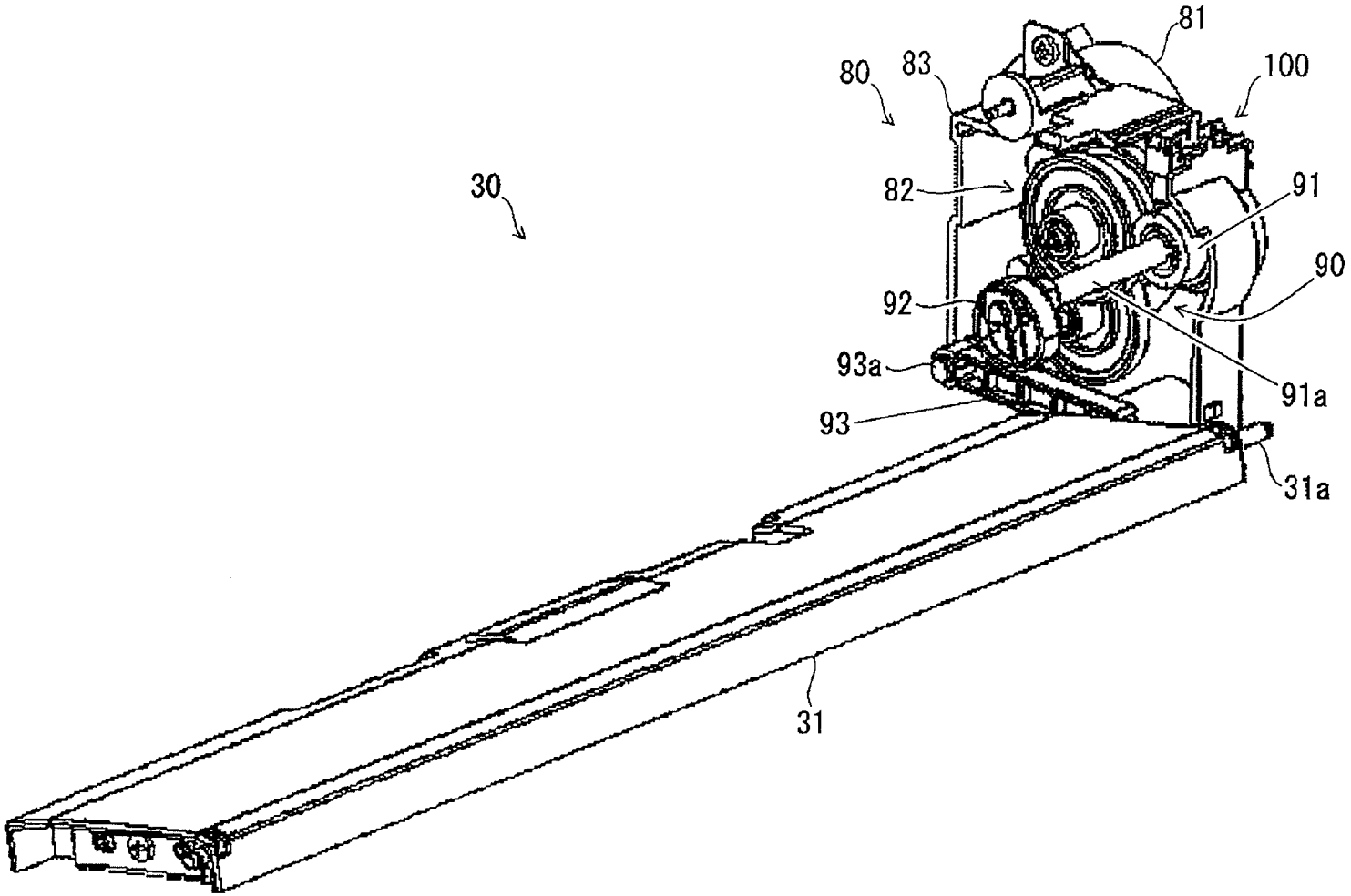
FIG. 5 is a partially enlarged perspective view of the lift plate in FIG. 2 and a driving mechanism therefor as seen from the front.

As shown in FIGS. 4 and 5, the sheet feeding device 30 includes a driving mechanism 80 for the lift plate 31. The driving mechanism 80 is disposed at the rear side of the apparatus body, and on the downstream side of a downstream-side end, in the document conveyance direction, of the lift plate 31. The driving mechanism 80 includes a lifting mechanism 90 for lifting up and down the lift plate 31, and also includes: a motor 81 serving as a driving source for driving the lifting mechanism 90; a group of gears 82; a housing 83; and a lower limit detecting device 100.

As shown in FIGS. 5 to 8, the lifting mechanism 90 includes: a driven gear 91; a cam 92; an operating lever 93; and a spring 94.

The driven gear 91 is fixed on a supporting shaft 91*a* extending substantially horizontally in the document width direction, namely in the front/rear direction, and is disposed rotatably around an axial line of the supporting shaft 91*a*. The supporting shaft 91*a* extends from the location of the driven gear 91 frontward. The driven gear 91 is coupled with a drive gear 81*a* of the motor 81 via the group of gears 82, and is rotated with a motive force transmitted from the motor serving as the driving source.

The cam 92 is fixed on a front-side end portion of the supporting shaft 91*a* serving as a rotating axis. Thus, the cam 92 rotates within a vertical plane with respect to the document conveyance direction as the supporting shaft 91*a* rotates. An outer peripheral surface of the cam 92 is formed a cam curve.

The operating lever 93 is disposed below the cam 92 independently from the cam 92 and the lift plate 31, and extends in a lateral direction from the location of the driving mechanism 80 to the lift plate 31 on the upstream side in the document conveyance direction (see FIG. 8). The operating lever 93 is supported on the apparatus body, at its downstream-side portion, by a supporting shaft 93*a* extending substantially horizontally in the document width direction, namely in the front/rear direction, and is freely swingable around an axial line of the supporting shaft 93*a* so that its upstream-side end portion as a free end swings up and down.

The operating lever 93 is located in position such that its upper surface is with respect to the peripheral surface of the cam 92. The outer peripheral surface of the cam 92 makes contact with an upper surface of the operating lever 93, substantially between the supporting shaft 93*a* and the upstream-side end portion of the lever. As shown in FIGS. 6 and 8, the upstream-side end portion of the operating lever 93 serving a free end, at its lower surface, makes contact with an upper side of a peripheral surface of an operating pin 31*b* extending substantially horizontally from the downstream-side end portion of the lift plate 31 rearward. Thus, the lift plate 31 and the cam 92 are arranged on sides opposite to each other with the operating lever 93 in between. The operating lever 93 is between the cam 92 and the lift plate 31 and swings in line with the shape of the outer peripheral surface of the cam 92 so as to change a posture of the lift plate 31.

As shown in FIG. 9, the operating lever 93 is so formed as to have an I-shape in a cross section perpendicular to a longitudinal direction. The cam 92 abuts on the operating lever 93 from above the I-shape and the operating pin 31*b* of the lift plate 31 abuts on the operating lever 93 from below the I-shape.

On the other hand, the spring 94 is disposed below the lift plate 31. The spring 94 is a biasing member that is arranged between an unillustrated frame of the document feeding apparatus 20 and the lift plate 31 and that biases the downstream-side portion of the lift plate 31 upward, namely toward the sheet feeding section 70. With this construction, the cam 92 and the operating lever 93 are arranged, with respect to the lift plate 31, on a side opposite to a direction in which the spring 94 biases the lift plate 31; accordingly, the operating lever 93 abutting on the outer peripheral surface of the cam 92 presses the operating pin 31*b* of the lift plate 31 against a biasing force of the spring 94. Thus, the operating pin 31*b* of the lift plate 31 and operating lever 93, and the operating lever 93 and cam 92 keep contact with each other all the time. As a result, when the cam 92 is rotated with a motive force transmitted from the motor 81, the operating lever 93, at its free-end side, swings up and down in line with the shape of the outer peripheral surface of the cam 92, and changes the posture of the lift plate 31 between a sheet feeding position and a sheet loading position.

As shown in FIGS. 7 and 8, the lower limit detecting device 100 includes a shielding plate 101 and a lower limit sensor 102.

The shielding plate 101 extends in a radially outward direction of the supporting shaft 91*a* of the driven gear 91 and is fixed on the supporting shaft 91*a*. The shielding plate 101 is disposed in the vicinity of the driven gear 91, and is so formed as to have substantially a sector shape when seen from the front thereof. The shielding plate 101 is disposed on the supporting shaft 91*a* such that it protrudes upward when the cam 92 fixed on the supporting shaft 91*a* is in a state of pressing the operating lever 93 down to a lowest position thereof, namely the lift plate 31 is in a state of being pressed down to a lowest position thereof (see FIG. 8).

The lower limit sensor 102 is arranged in position corresponding to and above the driven gear 91. The lower limit sensor 102 is composed of a photointerrupter, which is an optical sensor, and includes a light emitting portion and a light receiving portion with a gap in between. The lower limit sensor 102 indicates incidence of light emitted from the light emitting portion on the light receiving portion. That is, the lower limit sensor 102 senses the shielding plate 101 emerging between the light emitting and receiving portions. When the lift plate 31 is in the state of being pressed down to the lowest position, the shielding plate 101 protrudes upward, namely toward the lower limit sensor 102; the lower limit sensor 102 can indicates a lower limit position that is the sheet loading position of the lift plate 31.

Among the above-described constituent components of the driving mechanism 80, the motor 81, the group of gears 82, the lifting mechanism 90, and the lower limit detecting device 100 except the spring 94 are collected inside the housing 83, and are thus formed into a unit as shown in FIGS. 5 to 7.

Figure 10:
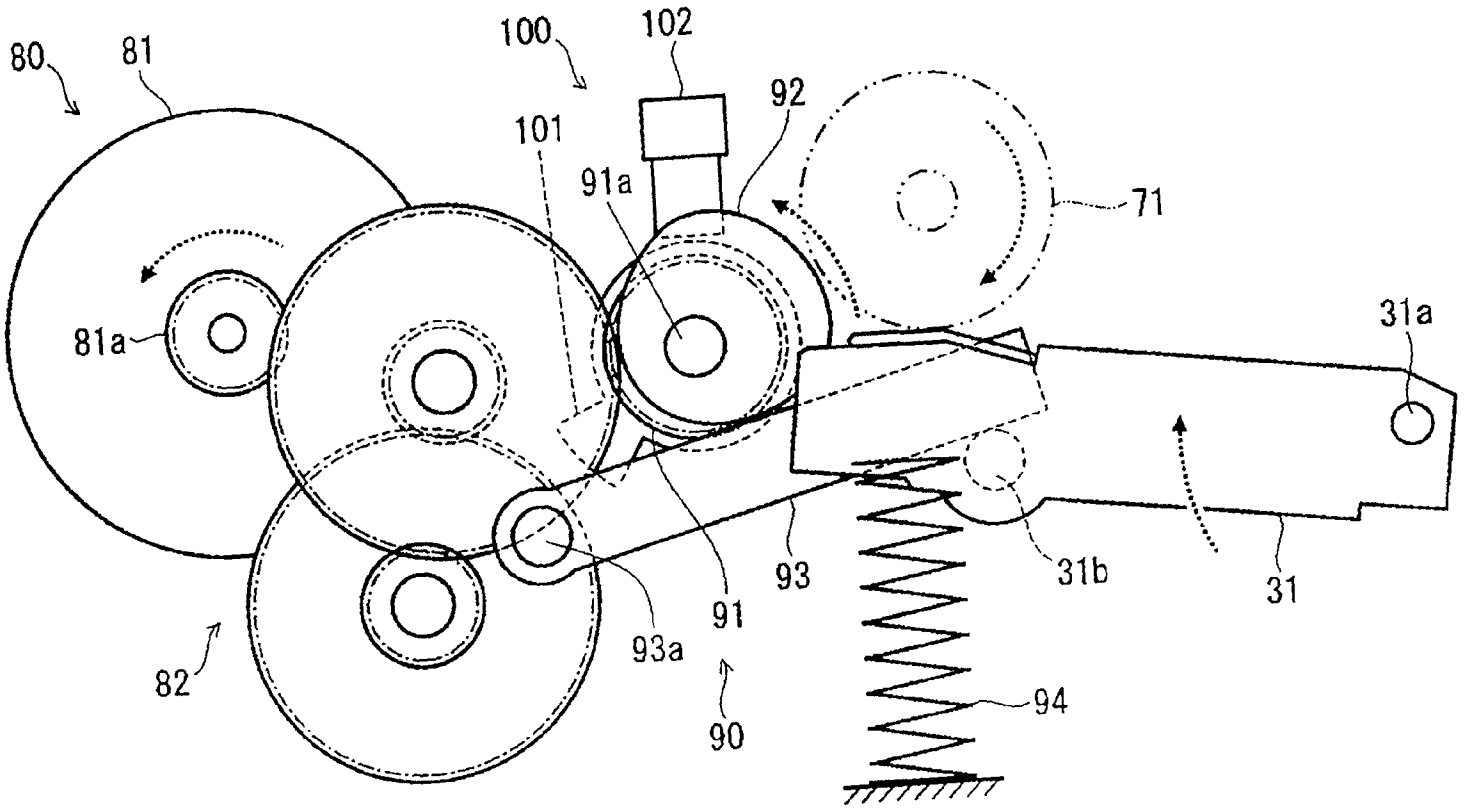
FIG. 10 is a partially enlarged front view of the same arrangement of the lift plate and the driving mechanism therefor as in FIG. 8, showing the lift plate forming a different posture from FIG. 8.

Next, a sheet feeding operation of the sheet feeding device 30 will be described with reference to FIG. 10 in addition to FIG. 8. FIG. 10 is a partially enlarged front view of the same arrangement of the lift plate and the driving mechanism therefor as in FIG. 8, showing the lift plate forming a different posture from FIG. 8.

When the sheet feeding device 30 is not engaged in the operation of feeding a sheet of a document from the document loading tray 21 toward the document reading section 43, since an additional sheet of a document may be loaded on the document loading tray 21, the lift plate 31 is made to maintain its posture in the sheet loading position, where, as shown in FIG. 8, its downstream-side portion is in its lowest position. When the lift plate 31 is in the sheet loading position, the operating lever 93 takes a substantially horizontal position.

In this connection, inside the driving mechanism 80, as described earlier, the lower limit sensor 102 of the lower limit detecting device 100 detects the lift plate 31 being pressed down into the sheet feeding position by the cam 92 and the operating lever 93. The document feeding apparatus 20, when recognizing the document loading tray 21 running out of the sheets, controls the driving mechanism 80 of the sheet feeding device 30 to make the lifting mechanism 90 operate so as to lift the lift plate 31 down to the sheet loading position, to maintain it in that position, and thereby to stop rotation of the pickup roller 71.

On the other hand, when a sheet of a document is loaded on the document loading tray 21, the document feeding apparatus 20, upon receiving a command indicating starting of the sheet feeding, controls the driving mechanism 80 to make the lifting mechanism 90 operate so as to lift the lift plate 31 up to the sheet feeding position.

Inside the driving mechanism 80, as shown in FIG. 10, the motor 81 rotates counterclockwise as seen from the front. Thus, fixed on the supporting shaft 91*a*, both cam 92 of the lifting mechanism 90 and shielding plate 101 of the lower limit detecting device 100 are rotated counterclockwise as seen from the front via the group of gears 82.

When the cam 92 is thus rotated, the upstream-side portion of the operating lever 93 and the downstream-side portion of the lift plate 31 are gradually raised under the action of an abutting position on the outer peripheral surface formed into a cam curve of the cam 92 and the force of repulsion of the spring 94. With rotation of the cam 92, the downstream-side portion of the lift plate 31 continues to rise until the pickup roller 71 makes contact with the uppermost one of the stacked sheets and the lift plate 31 reaches the sheet feeding position.

Meanwhile, the pickup roller 71 is allowed to swing up and down around an axial line of a supporting shaft substantially horizontally on the downstream side thereof within a vertical plane with respect to the document conveyance direction, and comes into contact with the uppermost one of the sheets of a document under its own weight serving as a contact pressure. A position of the pickup roller 71 at which an appropriate contact pressure against a sheet of a document is obtained is sensed by the upper limit sensor (not shown), and forms the sheet feeding position of the lift plate 31. When the lift plate 31 reaches that sheet feeding position, the pickup roller 71 and the sheet feeding belt 72 are rotated in the document conveyance direction, so that a sheet of a document is fed out of the document loading tray 21 (see FIG. 3) leftward in FIG. 9.

Presence of a sheet of a document loaded on the document loading tray 21 is being monitored all the time by use of a document set sensor (not shown). While the document loading tray 21 contains a sheet of a document, the pickup roller 71 is maintained in the sheet feeding position to make contact with the uppermost one with an appropriate contact pressure, the cam 92 is rotated counterclockwise finely according to a reduced number of sheets by use of the upper limit sensor, and thereby the posture of the lift plate 31 is adjusted. Thus, the sheets of a document are continuously fed out from the document loading tray 21 by the sheet feeding section 70.

Subsequently, when the document set sensor senses the last one of the sheets of a document stacked in the document loading tray 21, the document feeding apparatus 20 operates the driving mechanism 80 driving the lifting mechanism for the lift plate 31. This allows the driving mechanism 80 to rotate the cam 92 counterclockwise as seen from the front; accordingly, the cam 92 starts pressing down the upstream-side portion of the operating lever 93 and the downstream-side portion of the lift plate 31 against the force of repulsion of the spring 94. Then, when the shielding plate 101 of the lower limit detecting device 100 rotating with the cam 92 is about to reach the location of the lower limit sensor 102, the lower limit sensor 102 senses the presence of the shielding plate 101.

When the lower limit sensor 102 senses the presence of the shielding plate 101, the document feeding apparatus 20, as described earlier, stops the motor 81 of the driving mechanism 80 and also stops the rotation of the pickup roller 71. In this way, the lift plate 31 can be maintained in the sheet loading position as shown in FIG. 8.

Although the present invention has been described specifically by way of an embodiment, this is not meant to limit the scope of the present invention, and the present invention may be practiced in any way with various changes made without departing from the spirit of the invention.

For example, in the above-described embodiment, the sheet feeding device 30 of the present invention is incorporated in the document feeding apparatus 20 disposed at the top of the image forming apparatus 1 for the purpose of feeding a sheet of a document; however, this is not meant to limit the using of the sheet feeding device 30, and the sheet feeding device 30 of an embodiment of the present invention may be incorporated in the sheet feeding cassettes 2 or multi sheet feeding section 4 inside the image forming apparatus 1 for the purpose of feeding unprinted sheets. Moreover, the sheet feeding device 30 may also be incorporated in an apparatus other than the document feeding apparatus 20 and the image forming apparatus 1.

Moreover, in the above-described embodiment, the image forming apparatus 1 equipped with the document feeding apparatus 20 is an image forming apparatus for monochrome printing by a black toner alone; however, this is not meant to limit the type of image forming apparatus, and applications of an embodiment of the present invention may include tandem type and rotary rack type image forming apparatuses provided with an intermediate transfer belt and being capable of forming an image by laying a plurality of colors one over another.

Moreover, in the above-described embodiment, the lift plate 31 and the cam 92 are arranged on the sides opposite to each other with the operating lever 93 in between, so that the lift plate 31 abuts on the vicinity of the free end, and that the cam 92 abuts on substantially the middle portion of the operating lever 93 between the supporting shaft 93*a* and the free end; however, the supporting shaft 93*a* may be disposed in the upstream side of the operating pin 31*b* in the document conveyance direction, and the free end of the operating lever 93 may extend toward the downstream side in the document conveyance direction, so that the lift plate 31 abuts on the substantially middle portion of the operating lever 93 between the supporting shaft 93*a* and the free end, and that the cam 92 abuts on the free end.

What is claimed is:

1. A sheet feeding device comprising:

a sheet containing section;

a lift plate for lifting up and down sheets stacked in the sheet containing section between a sheet feeding position and a sheet loading position;

a sheet feeding section for separating and feeding the sheets in the sheet feeding position one after another; and a lifting mechanism for lifting up and down the lift plate, the lifting mechanism including:

a biasing member disposed at a side of lift plate for biasing the lift plate toward the sheet feeding section;

a cam, having an outer peripheral surface with a cam curve, fixed to a rotation shaft independent from the sheet feeding section so as to be coupled with a driving force source and rotated thereby; and an operating lever disposed at an opposite side of the lift plate that is opposite said side at which the biasing member is disposed, and provided independently of and between the cam and the lift plate so as to always remain in contact with the outer peripheral surface of the cam and the lift plate, and to simultaneously press the lift plate against a biasing force of the biasing member, thereby to change a posture of the lift plate between the sheet feeding position and the sheet loading position, wherein the lifting mechanism keeps the lift plate in a lowest posture when not feeding a sheet, rotates the cam to raise the lift plate to the sheet feed position so as to keep an uppermost one of the sheets in the sheet feeding position before feeding out the uppermost one sheet and then starts feeding the uppermost one sheet, rotates the cam to move the lift plate back into the lowest posture when a sheet in the sheet containing section is detected as the last sheet therein, and controls the posture of the lift plate by rotating the cam, which always remains in contact with the lift plate, via the operating lever such that the lift plate remains in the sheet feeding position and the sheet feeding section is in contact with the uppermost one sheet so long as a sheet is present in the sheet containing section, irrespective of a number of sheets.

2. The sheet feeding device according to claim 1, wherein the operating lever is, at one side thereof, supported on a body of the apparatus by a supporting shaft provided on said one side and is, at another side thereof serving as a free end, swingable around an axial line of the supporting shaft, and the cam and the lift plate are arranged opposite each other with the operating lever in between, so that the lift plate abuts on a vicinity of the free end of the operating lever and that the cam abuts on a middle portion, between the supporting shaft and the free end, of the operating lever.

3. The sheet feeding device according to claim 2, wherein the lift plate is, at one side thereof, so supported on the body of the apparatus as to be, at another side thereof serving as a free end, swingable around an axial line of a supporting shaft provided on the one side thereof, and the lift plate further includes, at another side thereof, an operating pin for abutting on the free end of the operating lever.

4. The sheet feeding device according to claim 2, wherein when the lift plate is in the sheet loading position, the operating lever takes a substantially horizontal position.

5. The sheet feeding device according to claim 1, wherein the operating lever has an I-shape, and from above and below the I-shape, the cam and the lift plate abut on the operating lever, respectively.

6. The sheet feeding device according to claim 1, wherein the cam and the operating lever are arranged at the lift plate opposite to a direction in which the biasing member biases the lift plate.

7. A document feeding apparatus equipped with a sheet feeding device comprising:

a sheet containing section;

a lift plate for lifting up and down sheets stacked in the sheet containing section between a sheet feeding position and a sheet loading position;

a sheet feeding section for separating and feeding the sheets in the sheet feeding position one after another; and a lifting mechanism for lifting up and down the lift plate, the lifting mechanism including:

a biasing member disposed at a side of lift plate for biasing the lift plate toward the sheet feeding section;

a cam, having an outer peripheral surface with a cam curve, fixed to a rotation shaft independent from the sheet feeding section so as to be coupled with a driving force source and rotated thereby; and an operating lever disposed at an opposite side of the lift plate that is opposite said side at which the biasing member is disposed, and provided independently of and between the cam and the lift plate so as to always remain in contact with the outer peripheral surface of the cam and the lift plate, and to simultaneously press the lift plate against a biasing force of the biasing member, thereby to change a posture of the lift plate between the sheet feeding position and the sheet loading position, wherein the lifting mechanism keeps the lift plate in a lowest posture when not feeding a sheet, rotates the cam to raise the lift plate to the sheet feed position so as to keep an uppermost one of the sheets in the sheet feeding position before feeding out the uppermost one sheet and then starts feeding the uppermost one sheet, rotates the cam to move the lift plate back into the lowest posture when a sheet in the sheet containing section is detected as the last sheet therein, and controls the posture of the lift plate by rotating the cam, which always remains in contact with the lift plate, via the operating lever such that the lift plate remains in the sheet feeding position and the sheet feeding section is in contact with the uppermost one sheet so long as a sheet is present in the sheet containing section, irrespective of a number of sheets.

8. An image forming apparatus equipped with a sheet feeding device comprising:

a sheet containing section;

a lift plate for lifting up and down sheets stacked in the sheet containing section between a sheet feeding position and a sheet loading position;

a sheet feeding section for separating and feeding the sheets in the sheet feeding position one after another; and a lifting mechanism for lifting up and down the lift plate, the lifting mechanism including:

a biasing member disposed at a side of lift plate for biasing the lift plate toward the sheet feeding section;

a cam, having an outer peripheral surface with a cam curve, fixed to a rotation shaft independent from the sheet feeding section so as to be coupled with a driving force source and rotated thereby; and an operating lever disposed at an opposite side of the lift plate that is opposite said side at which the biasing member is disposed, and provided independently of and between the cam and the lift plate so as to always remain in contact with the outer peripheral surface of the cam and the lift plate, and to simultaneously press the lift plate against a biasing force of the biasing member, thereby to change a posture of the lift plate between the sheet feeding position and the sheet loading position, wherein the lifting mechanism keeps the lift plate in a lowest posture when not feeding a sheet, rotates the cam to raise the lift plate to the sheet feed position so as to keep an uppermost one of the sheets in the sheet feeding position before feeding out the uppermost one sheet and then starts feeding the uppermost one sheet, rotates the cam to move the lift plate back into the lowest posture when a sheet in the sheet containing section is detected as the last sheet therein, and controls the posture of the lift plate by rotating the cam, which always remains in contact with the lift plate, via the operating lever such that the lift plate remains in the sheet feeding position and the sheet feeding section is in contact with the uppermost one sheet so long as a sheet is present in the sheet containing section, irrespective of a number of sheets.

* * * * *